US005581921A

United States Patent [19]

Hutchens

[11] Patent Number: 5,581,921

[45] Date of Patent: Dec. 10, 1996

[54] ADVERTISEMENT BRAND SIGN FOR SNAPPING ON AND OFF A BEVERAGE PITCHER

[76] Inventor: Timothy M. Hutchens, 12 White Tail La., Trumbull, Conn. 06611

[21] Appl. No.: 517,138

[22] Filed: Aug. 21, 1995

Related U.S. Application Data

[63] Continuation-in-part of Ser. No. 66,898, May 21, 1993, abandoned.

[51] Int. Cl.[6] ..... G09F 3/00

[52] U.S. Cl. ..... 40/324; 40/666

[58] Field of Search ..... 40/324, 658, 666; 24/551, 552, 553

[56] References Cited

U.S. PATENT DOCUMENTS

| | | | |
|---|---|---|---|
| 179,476 | 7/1876 | Hearttagen . | |
| 396,224 | 1/1889 | Mueller . | |
| 1,083,853 | 1/1914 | Overbeck | 40/666 X |
| 1,699,311 | 1/1929 | Randall . | |
| 2,010,534 | 8/1935 | Collins . | |
| 2,013,617 | 9/1935 | Werfel . | |
| 2,040,750 | 5/1936 | Long . | |
| 2,066,877 | 1/1937 | Cruver . | |
| 2,363,418 | 11/1944 | Hosmer . | |
| 2,583,020 | 1/1952 | Smith | 24/551 |
| 2,810,176 | 10/1957 | Gaafar | 24/551 |
| 2,924,900 | 2/1960 | Hoofer . | |
| 2,938,252 | 5/1960 | Scheemaeker . | |
| 3,164,126 | 1/1965 | Matel et al. . | |
| 3,327,376 | 6/1967 | Freeman et al. | 24/553 X |
| 4,044,485 | 8/1977 | Hopp . | |
| 4,882,862 | 11/1989 | Slavsky, Sr. . | |
| 5,159,731 | 11/1992 | Dereadt | 24/552 |

*Primary Examiner*—Brian K. Green

*Attorney, Agent, or Firm*—Ware, Fressola, Van Der Sluys & Adolphson

[57] ABSTRACT

An advertising brandsign is provided for snapping on and off a beverage pitcher having a brandsign connected to a fastener. The brandsign advertises a brandname of a beverage in the beverage pitcher. The fastener has a flexible U-shaped portion with two overlapping ends. Each of the two overlapping ends has contacting faces forceably biased closed so as to touch each other. The flexible U-shaped portion has side portions for pressing inwardly to open the contacting faces and for releasing to close the contacting faces for attaching the advertising brandsign to and from the beverage pitcher.

4 Claims, 5 Drawing Sheets

ADVERTISEMENT BRAND SIGN FOR SNAPPING ON AND OFF A BEVERAGE PITCHER

This is a continuation-in-part of application Ser. No. 08/066,898 filed on May 21, 1993, now abandoned.

This invention relates to an advertising brand sign for a bar or beverage pitcher. More particularly, the invention relates to a brand sign which detachably fastens by snapping on and off the bar pitcher.

BACKGROUND OF THE INVENTION

There are many known prior art brand signs. For example, Mueller (U.S. Pat. No. 396,224) shows a false lid for beer steins or glasses, with a multi-page stack of advertising pages, inside. Hoofer (U.S. Pat. No. 2,924,900) shows a snap-on "price tag clip" for the upstanding rim of a tray, pan or bowl. Werfel (U.S. Pat. No. 2,013,617) and Collins (U.S. Pat. No. 2,010,534) both show mixed drink pitchers with mixing recipes displayed by slidable "windows". Cruver (U.S. Pat. No. 2,066,877) shows a removable draft logo sign for draft dispensing spigots. Thus the Cruver patent shows draft beverage logo signs, and the Hoofer patent shows resilient spring clips for mounting display signs on a vessel's rim. Neither the Cruver nor Hoofer patents involved pitchers.

BRIEF SUMMARY OF THE INVENTION

Accordingly, it is one object of the present invention to provide an advertising brand sign for detachably fastening on a bar pitcher.

This object is accomplished, at least in part, by an advertising brandsign for snapping on and off a beverage pitcher having a brandsign connected to a fastener. The brandsign advertises a brandname of a beverage in the beverage pitcher. The fastener has a flexible U-shaped portion with two overlapping ends. Each of the two overlapping ends has contacting faces forceably biased closed so as to touch each other. The flexible U-shaped portion has side portions for pressing inwardly to open the contacting faces and for releasing to close the contacting faces for attaching the advertising brandsign to and from the beverage pitcher.

One important advantage of the invention is that it significantly increases the product awareness and brandname recognition of the beverage contained in the pitcher.

Other objects and advantages of the present invention will become apparent to those skilled in the art from the following detailed description of the invention when read in conjunction with the appended claims and the drawing attached hereto.

THE DRAWING

For a fuller understanding of the nature and objects of the invention, reference should be made to the following detailed description taken in connection with the accompanying drawing, not drawn to scale, in which.

Figure 10C:
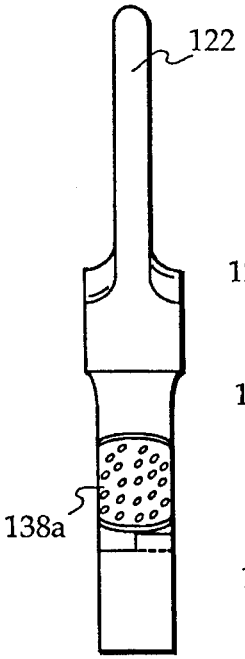
Figure 10B:
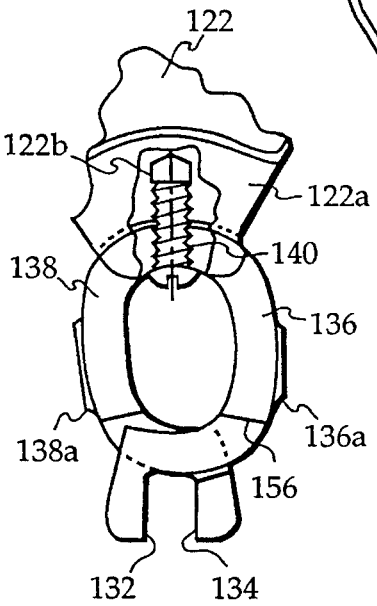
Figure 10A:
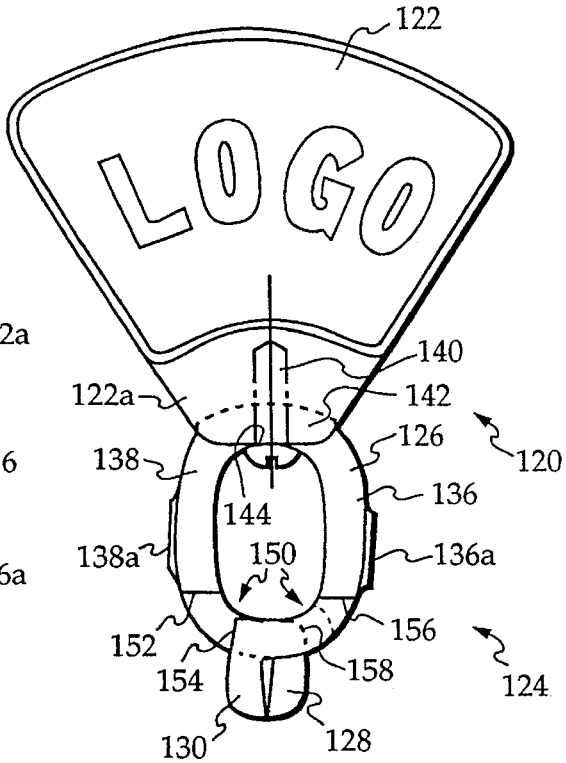

FIG. 10(A), 10(B), 10(C) show another embodiment of the invention, including FIG. 10(A) which is a front view of the embodiment, FIG. 10(B) which is a partial cut-away view of the embodiment shown in FIG. 10(A), and FIG. 10(C) which is a side view of the embodiment shown in FIG. 10(A).

BEST MODE FOR CARRYING OUT THE INVENTION

Figure 1:
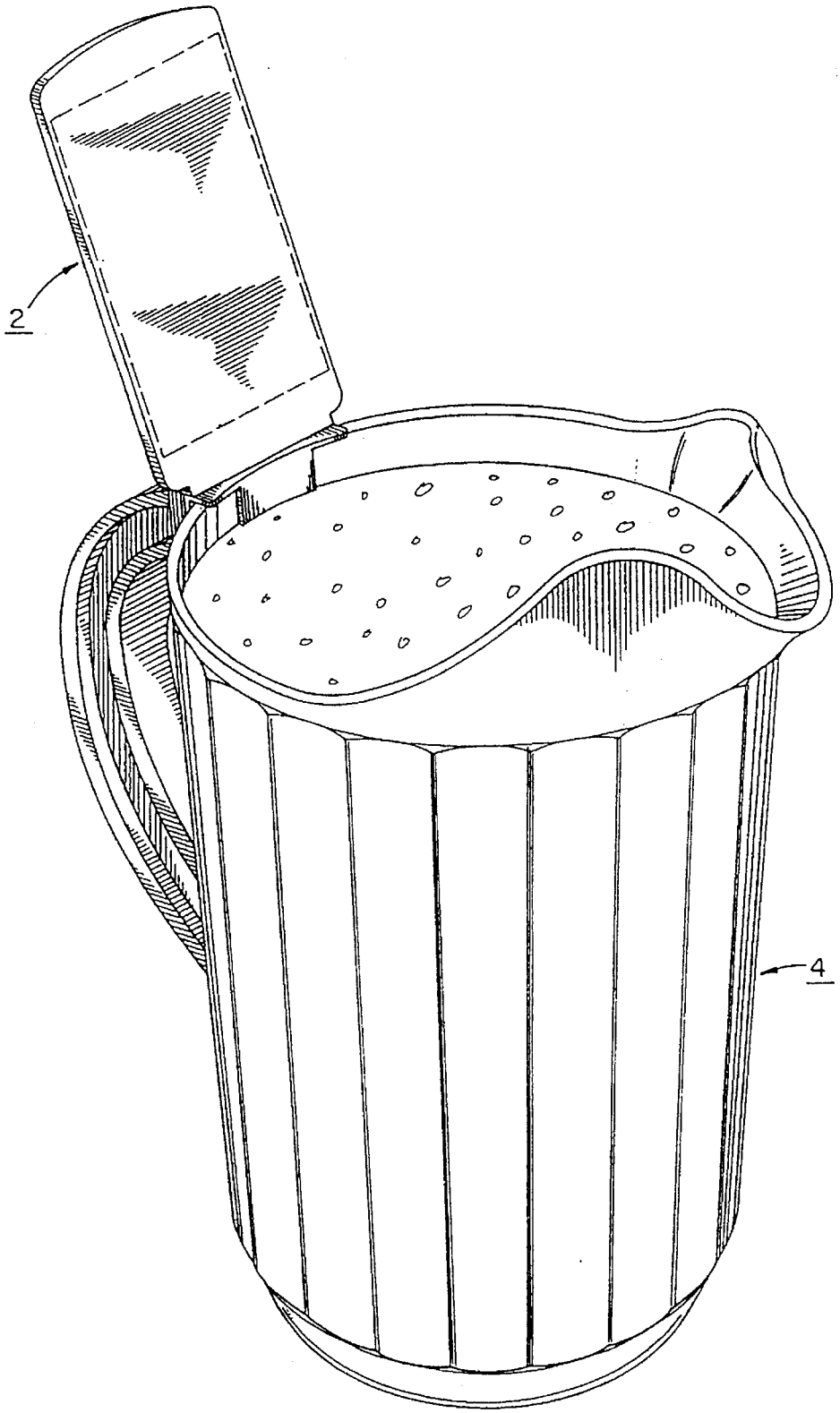
FIG. 1 shows a perspective view of the brand sign arranged on a pitcher.

FIG. 1 shows a brand sign 2 arranged on a pitcher 4. As shown, the pitcher 4 is filled with a cold beverage having a brandname "X".

Figure 2:
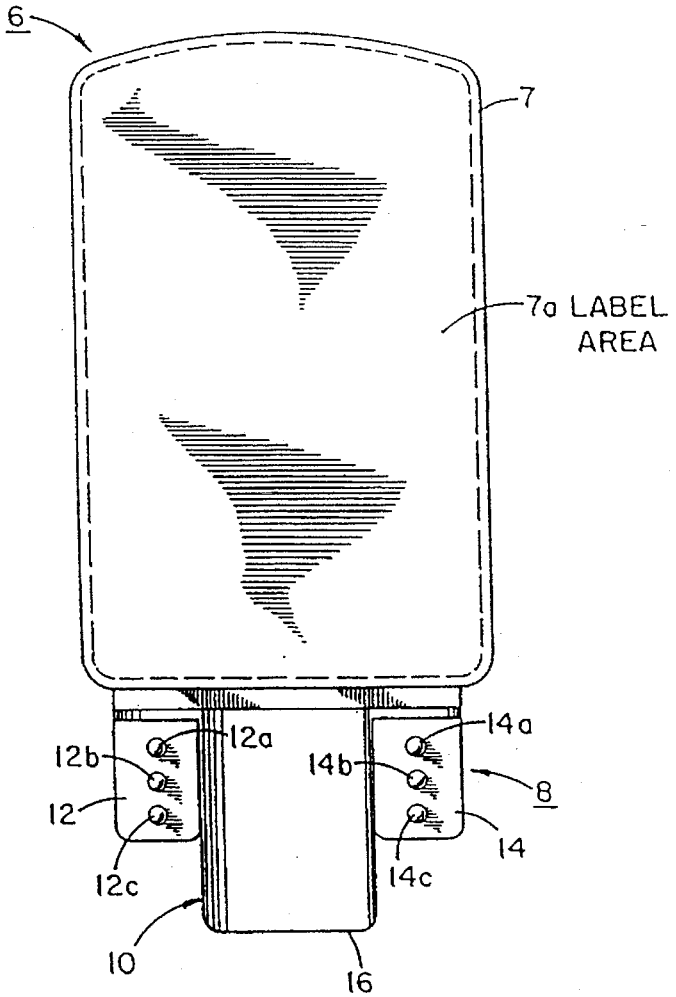
FIG. 2 shows a front view of the brand sign without the pitcher shown in FIG. 1.

As shown in FIG. 2, the brand sign 2 includes two principle elements, i.e. a means for displaying 6 a brandname for the beverage in the pitcher 4; and a means for detachably fastening 8 the means for displaying 6 on the pitcher 4. The beverage is usually beer or soda.

Figure 3:
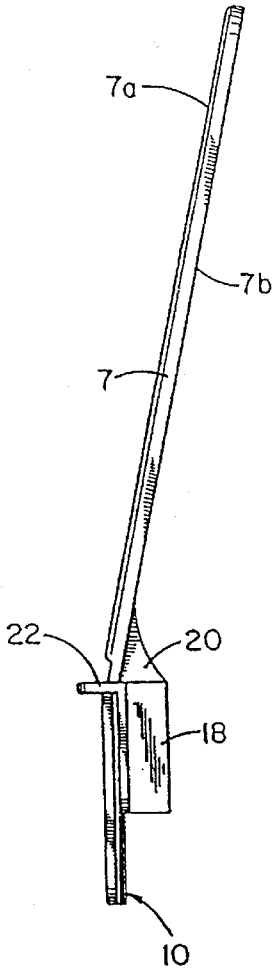
FIG. 3 shows a side view of the brand sign shown in FIG. 2.

The means for displaying 6 includes a flat display 7 with a front displaying surface 7*a* and a rear displaying surface 7*b* (FIG. 3). As shown, in one embodiment the flat display 7 has a height of 3.625" and a width of about 2.00"; however, the scope of the invention is not limited to these dimensions.

The means for detachably fastening 8 includes a plastic clip 10 for snapping onto a rim of the pitcher 4, as best shown in FIG. 1. The plastic clip 10 includes small tabs 12, 14 and a larger tab 16. In one embodiment, as shown, the small tabs 12, 14 have a length of ¾" and a width of ½", and the large tab 16 has a length of 1.25" and a width of 1"; however, the scope of the invention is not limited to these dimensions. In one embodiment the small tabs 12, 14 are disposed outside the rim and the large tab 16 is disposed inside the rim (FIG. 1), although the arrangement could be reversed. Each of the small tabs 12, 14 includes respectively detents 12*a*, 12*b*, 12*c*, 14*a*, 14*b*, 14*c* for positioning and holding the brand sign 2 in relation to the pitcher 4 so the brand sign Z can be released from the pitcher 4 by a suitably applied upward force thereto, as shown. The small tab 12 is disposed with respect to the other small tab 14 so each of their respective detents 12*a*, 12*b*, 12*c*, 14*a*, 14*b*, 14*c* are disposed in the grooves between the ridges on the circumferential surface of the pitcher shown in FIG. 1, for aligning and positioning the brandsign 2 with respect to the pitcher 4. The detents 12*a* and 14*a* cooperate with the rim of the pitcher 4 shown in FIG. 1, as discussed below, for tightly holding the brandsign 2 in place. The brand sign 2 is intended to be readily interchangeable when the pitcher 4 is filled with a beverage having a different brandname.

As shown in FIG. 3, the plastic clip 10 also includes a strengthening rib 18 having a top rib member 20 for bracing the flat display 7 with respect to the plastic clip 10. As shown, in one embodiment, the flat displaying 7 is inclined at a 15 degree angle with respect to the plastic clip 10; however, the scope of the invention is not limited to this angle.

Figure 4:
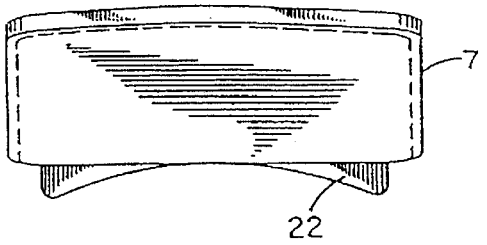
FIG. 4 shows a top view of the brand sign shown in FIG. 2.

FIG. 4 shows that the plastic clip 10 has a stabilizer member 22 (see also FIG. 3) for resting on top of the rim of the pitcher 4 (FIG. 1), so the brand sign 2 maintains a steady attitude with respect to the pitcher 4. The rim of the pitcher 4 shown in FIG. 1 is actually disposed between the stabilizer member 22 and the detents 12*a* and 14*a* for tightly holding the brandsign 2 in place. As shown, the plastic clip 10 also has a shape which is contoured to a corresponding shape of the dispenser 4 (FIG. 1). For a bar pitcher having a radius of about 2.375" the plastic clip 10 would have a corresponding radius of about 2.375" as well; however, the scope of the invention is not limited to these dimensions.

Figure 9:
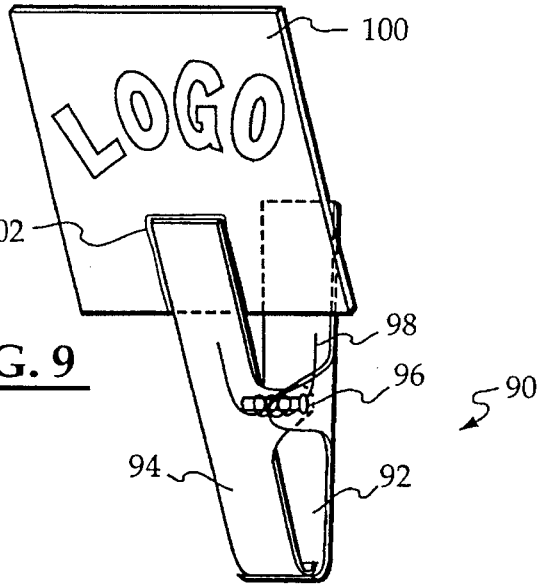
FIG. 9 shows another embodiment of the invention.

The means for detachably fastening 8 can also include a spring clip generally indicated as 90 as shown in FIG. 9 for snapping onto a handle (FIG. 1) of the pitcher 4. The spring clip 90 includes first and second clipping member 92, 94 pivotally mounted in a pin 96 having a biasing spring 98. The brandsign generally indicated as 100 is attached to the second clipping member 94 by adhesive or bonding means generally indicated as 102. The scope of the invention is not limited to only adhesive means or bonding means because embodiments are envisioned in which the brandsign 100 is attached to the second clipping member 94 by riveting means (not shown) or any other durable fastening means.

The scope of the invention is also not limited to only detachably fastening the brand sign Z to the rim of the pitcher 4, it may also be readily detachably fastened to the handle of the pitcher 4 as well.

Figure 5:
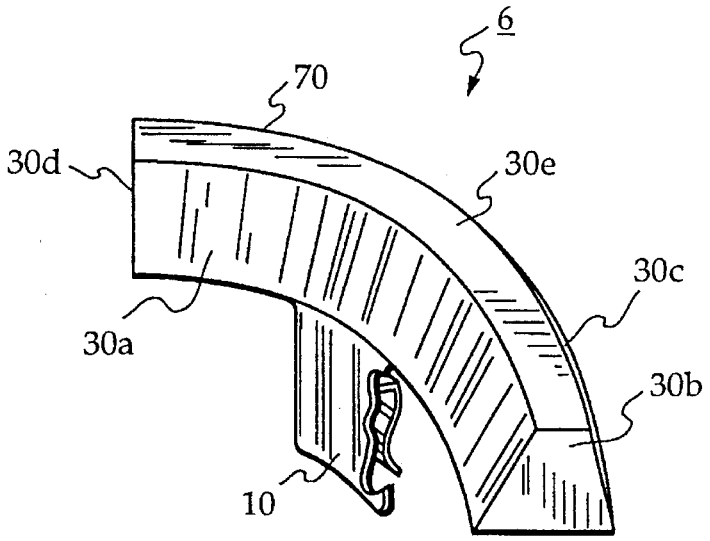
FIG. 5 shows another embodiment of the brand sign.
Figure 7:
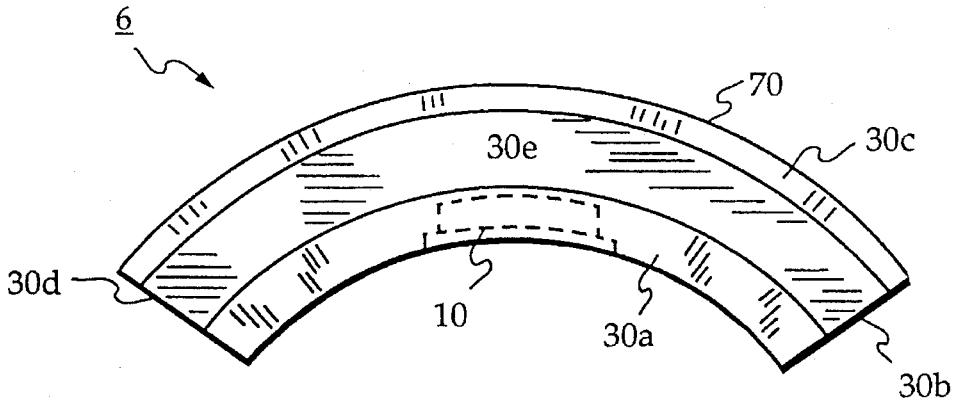
FIG. 7 shows a top view of the brand sign shown in FIG. 5.
Figure 6:
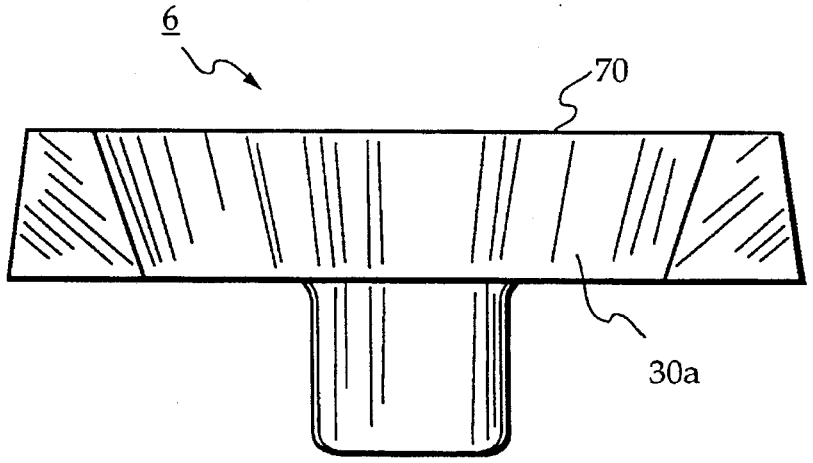
FIG. 6 shows a front view of the brand sign shown in FIG. 5.

As shown in FIGS. 5–7, the means for displaying 6 also includes a three dimensional display 70 for the brandname for the beverage contained in the pitcher 4. As shown, the three dimensional display 70 is geometrically shaped as a truncated trapezoidal toroid, having a surface generated by a plane closed curve shaped as a trapezoid and rotated about a line that lies in the same plane as the trapezoid but does not intersect it. The term "truncated" as used herein, means that the plane is rotated less than 360 degrees about the line. (The line would be the axis of the pitcher.) The three dimensional display 70 has five displaying surfaces 30*a*, 30*b*, 30*c*, 30*d*, 30*e*, including front and back surfaces 30*a*, 30*c*, opposing side surfaces 30*b*, 30*d*, and a top surface 30*e*. The key feature of the three dimensional brand sign 70 is to maximize the visibility of the brandname from any direction relative to the bar pitcher. The bottom surface (not shown) would generally not be used as a display surface, unless, of course, the pitcher 4 was to be used on a mirrored table (not shown). The arc section of the three dimensional display 70 is truncated to about 90 degree, although 180 degrees or 270 degree embodiments are also envisioned. The arc section of the three dimensional, display 70 is only limited to the extent that the brand sign 2 physically interferes with the pouring of the beverage from the pitcher 4, which is shown in partial phantom lines (see FIG. 1). As shown, the front and back surfaces 30*a*, 30*c* having a substantially similar radius of curvature with respect to the axis of the pitcher 4 (FIG. 1).

The three dimensional display 70 is also not geometrically limited to a truncated trapezoidal toroid. For example, other three-dimensional geometric shapes may include a truncated toroid, also better known as a partial donut (not shown), a truncated triangular toroid (not shown), and may also include any surface generated by a plane closed curve rotated about a line that lies in the same plane as the plane but does not intersect it. The most important aspect of the three dimensional display 70 is to have many advertising surfaces to maximize the visibility of the brandname from any angles with respect to the pitcher 4.

Figure 8:
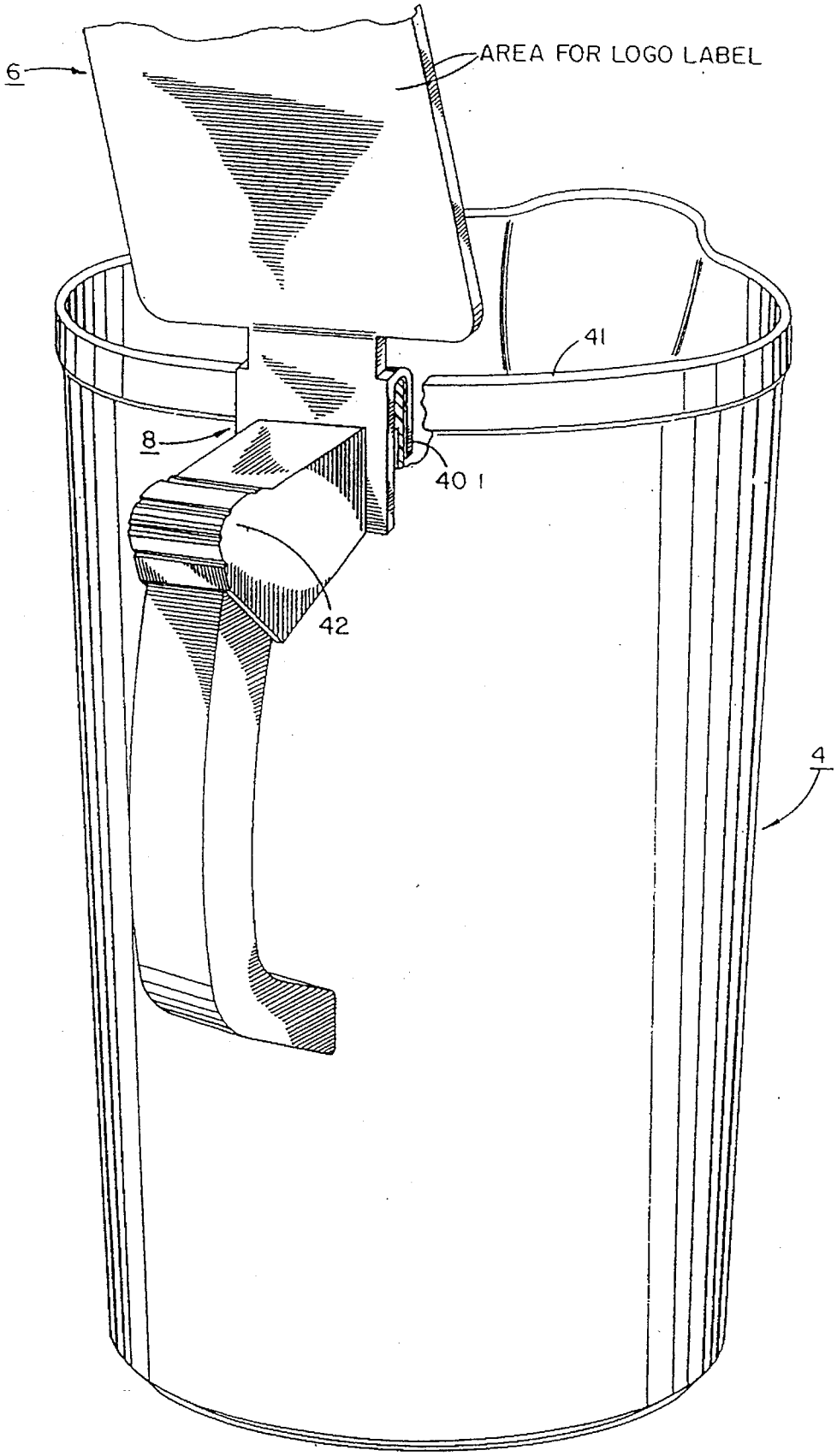
FIG. 8 shows still another embodiment of the brand sign.

As shown in FIG. 8, the means for detachably fastening 8 includes a plastic hook 40 for frictionally clipping onto the rim 41 of the pitcher 4. The means for detachably fastening 8 also includes a thump grip 42 for steadying the brand sign 2 when pouring the beverage from the pitcher 4.

FIGS. 10(A), 10(B), 10(C) show another embodiment of the advertising brandsign generally indicated as 120 for snapping on and off a beverage pitcher. The advertising brandsign 120 includes a brandsign 122 for advertising a brandname of a beverage in the beverage pitcher. The advertising brandsign 120 includes fastening means generally indicated as 124 having a flexible U-shaped portion 126 with two overlapping ends 128, 130. Each of the two overlapping ends 128, 130 have contacting faces 132, 134 forceably biased closed so as to touch each other as best shown in FIG. 10(A). The flexible U-shaped portion 126 has side portions 136, 138 for pressing inwardly to open the contacting faces 132, 134 (as best shown in FIG. 10(B)) and for releasing to close the contacting faces 132, 134 for attaching the brandsign 122 to and from the beverage pitcher (not shown).

The advertising brandsign 120 includes means generally indicated as 140 for affixing the brandsign to the fastening means. As shown, the means 140 for affixing the brandsign to fastening means 124 includes a screw 140. In this embodiment, the brandsign 122 has a base 122*a* with a bore means 122*b* for receiving the screw 140. The U-shaped portion 126 has a pivot portion 142 with an aperture generally indicated as 144 through which the screw 140 passes. However, the scope of the invention is not intended to be limited to only screwing the brandsign 122 to the fastening means 124, because embodiments are envisioned wherein the means 140 for affixing the brandsign 122 to fastening means 124 may include adhesively bonding the brandsign 122 to fastening means 124, or a snap lock fit.

To assist the user in affixing the advertising brandsign 120 to the pitcher, the side portions 136, 138 have frictionally engaging means generally indicated as 136*a*, 138*a* for frictionally engaging fingertips. The frictionally engaging means 138*a* is best shown in FIG. 10(C).

Each of the two overlapping ends 128, 130 also has flex reducing means generally indicated as 150 for limiting the amount that the flexible U-shaped portion can be pressed inwardly when opening the contacting faces, to reduce the possibility of breaking the flexible U-shaped portion 124. The flex reducing means 150 includes respective blocking faces 152, 154 and 156, 158 for contacting with the other of the two overlapping ends 128, 130.

Finally, it will thus be seen that the objects set forth above, and those made apparent from the preceding description, are efficiently attained and, since certain changes may be made in the above construction without departing from the spirit and scope of the invention, it is intended that all matters contained in the above description or shown in the accompanying drawing shall be interpreted as illustrative and not in a limiting manner.

It is also to be understood that the following claims are intended to cover all of the generic and specific features of the invention herein described, as a matter of language, might be said to fall therebetween.

What is claimed is:

1. An advertising brandsign for snapping on and off a beverage pitcher, comprising:

a brandsign for advertising a brandname of a beverage in the beverage pitcher;

fastening means having a flexible U-shaped portion and two overlapping ends having contacting faces forcibly biased closed so as to touch each other, said flexible U-shaped portion having side portions for pressing inwardly to open said contacting faces and for releasing to close said contacting faces for attaching the brandsign to and from the beverage pitcher; and means for affixing said brandsign to said fastening means;

wherein said means for affixing said brandsign to said fastening means includes a screw; wherein said brandsign has a base with means for receiving the screw; and wherein said fastening means has a pivot portion with an aperture for receiving the screw.

2. An advertising brandsign according to claim 1, wherein said side portions of said fastening means have means for frictionally engaging fingertips of a user for pressing inwardly to open said contacting faces and for releasing to close said contacting faces for attaching the brandsign to and from the beverage pitcher.

3. An advertising brandsign according to claim 1, wherein each of the two overlapping ends has means for limiting the amount that said flexible U-shaped portion can be pressed inwardly when opening said contacting faces.

4. An advertising brandsign according to claim 3, wherein means for limiting the amount that said flexible U-shaped portion can be pressed inwardly when opening said contacting faces including respective blocking faces for contacting with the other of the two overlapping ends.

* * * * *

UNITED STATES PATENT AND TRADEMARK OFFICE

CERTIFICATE OF CORRECTION

PATENT NO. : 5,581,921

DATED : December 10, 1996

INVENTOR(S) : Timothy M. Hutchens

It is certified that error appears in the above-indentified patent and that said Letters Patent is hereby corrected as shown below:

At col. 2, line 47, delete "Z" and insert --2--.

At col. 3, line 24, delete "Z" and insert --2--.

Signed and Sealed this

Twenty-ninth Day of April, 1997

*Attest:*

Bruce Lehman

BRUCE LEHMAN

*Attesting Officer*

*Commissioner of Patents and Trademarks*